US011603679B2

(12) United States Patent
Lunday et al.

(10) Patent No.: US 11,603,679 B2
(45) Date of Patent: Mar. 14, 2023

(54) CHILD-RESISTANT DOOR HANDLE

(71) Applicant: Schlage Lock Company LLC, Carmel, IN (US)

(72) Inventors: Drake Lunday, Colorado Springs, CO (US); Nathanael Taylor, Colorado Springs, CO (US); Paul J. Meisel, Peyton, CO (US)

(73) Assignee: Schlage Lock Company LLC, Carmel, IN (US)

( * ) Notice: Subject to any disclaimer, the term of this patent is extended or adjusted under 35 U.S.C. 154(b) by 949 days.

(21) Appl. No.: 16/290,245

(22) Filed: Mar. 1, 2019

(65) Prior Publication Data

US 2020/0277805 A1 Sep. 3, 2020

(51) Int. Cl.
*E05B 13/00* (2006.01)
*E05B 15/00* (2006.01)

(52) U.S. Cl.
CPC ..... *E05B 13/005* (2013.01); *E05B 15/0033* (2013.01); *E05Y 2900/132* (2013.01); *Y10S 292/27* (2013.01); *Y10T 292/0834* (2015.04); *Y10T 292/865* (2015.04); *Y10T 292/96* (2015.04)

(58) Field of Classification Search
CPC ..... E05B 13/00; E05B 13/005; E05B 13/10; E05B 13/101; E05B 13/106; E05B 65/0014; E05B 55/00; E05B 55/005; E05B 55/06; E05B 1/0061; Y10S 292/27; Y10T 292/03; Y10T 292/0834; Y10T 292/084; Y10T 292/0964; Y10T 292/0977; Y10T 292/1016; Y10T 292/14; Y10T 292/96; Y10T 292/85; Y10T 292/865
USPC .... 70/218, 221–223, 422, 472, 149; 292/32, 292/37, 347
See application file for complete search history.

(56) References Cited

U.S. PATENT DOCUMENTS 257,048 A * 4/1882 Morrell ..... E05C 9/045 292/37
508,195 A * 11/1893 Whipple ..... E05B 3/003 292/352
856,558 A * 6/1907 Voight ..... E05B 13/004 292/359

(Continued)

FOREIGN PATENT DOCUMENTS

DE 803698 C * 4/1951 ..... E05B 13/005
DE 3906458 A1 * 9/1990

(Continued)

*Primary Examiner* — Carlos Lugo
(74) *Attorney, Agent, or Firm* — Taft Stettinius & Hollister LLC

(57) ABSTRACT

An exemplary handle assembly including a handle and a coupling mechanism. The handle includes a shank and a manually graspable portion extending from the shank. The coupling mechanism includes a coupling member and a cam sleeve. The coupling member is mounted to the shank for movement between a coupling position and a decoupling position. The cam sleeve is movably mounted to the shank and covers the coupling member. A radially-inner portion of the cam sleeve includes a cam surface operable to engage the coupling member. The cam surface is configured to drive the coupling member from the decoupling position to the coupling position as the cam sleeve is displaced from a home position to a displaced position.

26 Claims, 6 Drawing Sheets

(56) References Cited

U.S. PATENT DOCUMENTS

| | | | | | |
|---|---|---|---|---|---|
| 942,553 | A * | 12/1909 | Hamilton | E05B 55/005 | 70/DIG. 26 |
| 1,154,573 | A * | 9/1915 | Kemble | E05B 55/005 | 70/149 |
| 1,374,908 | A * | 4/1921 | Alpha | E05B 13/101 | 70/222 |
| 1,968,285 | A * | 7/1934 | Egan | E05B 13/005 | 292/172 |
| 2,610,877 | A | 9/1952 | Weaver | | |
| 2,676,050 | A * | 4/1954 | Nichols | E05B 13/005 | 292/348 |
| 2,801,869 | A * | 8/1957 | George | E05C 5/02 | 70/216 |
| 3,206,238 | A * | 9/1965 | Speight | E05B 13/005 | 192/114 R |
| 3,306,643 | A | 2/1967 | Reed | | |
| 5,381,919 | A * | 1/1995 | Griffin | B60K 15/0406 | 220/348 |
| 5,442,943 | A * | 8/1995 | Schremmer | H01H 27/06 | 70/252 |
| 5,524,786 | A * | 6/1996 | Skudlarek | B60K 15/0406 | 292/144 |
| 5,975,592 | A * | 11/1999 | Lin | E05C 1/06 | 292/159 |
| 6,179,352 | B1 | 1/2001 | Schneeberger | | |
| 7,334,824 | B2 | 2/2008 | Sundberg et al. | | |
| 7,441,713 | B2 * | 10/2008 | Nguyen | G05G 5/24 | 236/1 C |
| 7,802,828 | B2 | 9/2010 | Hopkins et al. | | |
| 8,100,443 | B2 | 1/2012 | Talpe | | |
| 8,353,188 | B1 * | 1/2013 | Byerly | E05B 13/005 | 70/210 |
| 9,834,956 | B2 | 12/2017 | Hogan | | |
| 11,002,049 | B2 * | 5/2021 | Demski | E05D 7/121 | |
| 2017/0226771 | A1 | 8/2017 | Ek | | |
| 2018/0209169 | A1 | 7/2018 | Cohen et al. | | |
| 2020/0248475 | A1 * | 8/2020 | Lunday | E05B 13/00 | |

FOREIGN PATENT DOCUMENTS

| | | | | |
|---|---|---|---|---|
| FR | 2672927 | A1 * | 8/1992 | E05B 13/005 |
| GB | 2279132 | A * | 12/1994 | E05B 13/005 |
| WO | WO-8707671 | A1 * | 12/1987 | E05B 13/005 |
| WO | 2002014634 | A1 | 2/2002 | |
| WO | 2018076052 | A1 | 5/2018 | |
| WO | 2018151698 | A1 | 8/2018 | |

* cited by examiner

CHILD-RESISTANT DOOR HANDLE

TECHNICAL FIELD

The present disclosure generally relates to child-resistant handles, and more particularly but not exclusively relates to child-resistant door handles.

BACKGROUND

It is occasionally desirable to discourage rotation of a handle by children, for example to prevent the child from opening a door, operating a faucet, or activating a burner on a stove. Certain conventional approaches to discouraging such rotation by children generally involve placing a shell on the knob such that the shell loosely encapsulates the knob and is rotatable relative to the knob. When a child attempts to rotate the knob, he or she instead grips and rotates the shell, which does not cause rotation of the knob or adjustment of the device that is controlled by the knob. The shell typically includes openings through which those with sufficient manual dexterity (e.g., adults) can grip the knob.

The above-described conventional approaches have certain drawbacks and limitations, such as those related to aesthetics, performance, and robustness. For example, the shell is typically aesthetically displeasing, and due to the loose mounting on the knob, can cause undesirable rattling. Additionally, the shell is typically formed of two pieces that snap together, and which can be separated from one another by children tampering with the shell. Furthermore, these approaches are generally not amenable to use with other forms of handles, such as levers. For these reasons among others, there remains a need for further improvements in this technological field.

SUMMARY

An exemplary handle assembly comprises a handle and a coupling mechanism. The handle includes a shank and a manually graspable portion extending from the shank. The coupling mechanism includes a coupling member and a cam sleeve. The coupling member is mounted to the shank for movement between a coupling position and a decoupling position. The cam sleeve is movably mounted to the shank and covers the coupling member. A radially-inner portion of the cam sleeve includes a cam surface operable to engage the coupling member. The cam surface is configured to drive the coupling member from the decoupling position to the coupling position as the cam sleeve is displaced from a home position to a displaced position. Further embodiments, forms, features, and aspects of the present application shall become apparent from the description and figures provided herewith.

DETAILED DESCRIPTION OF ILLUSTRATIVE EMBODIMENTS

Figure 1:
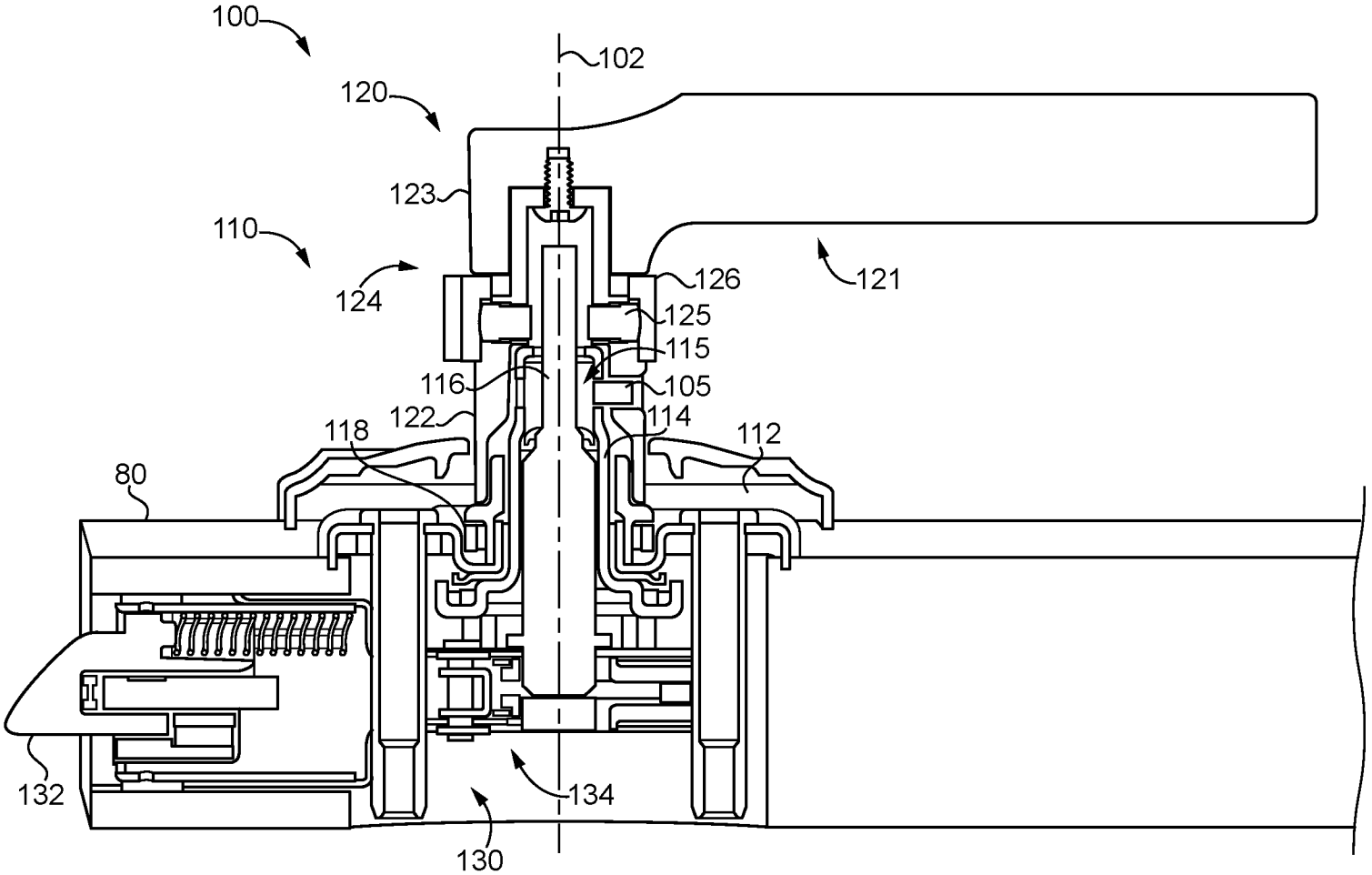
FIG. 1 is a cross-sectional illustration of a portion of a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a lockset 100 according to certain embodiments mounted to a door 80.

The lockset 100 generally includes a handleset 110 mounted to a side of the door 80, and a latch mechanism 130 including a latchbolt 132 operable to project beyond a swinging edge of the door 80. In the interest of clarity, the lockset 100 is illustrated with a single handleset (e.g., an outside handleset or an inside handleset). Those skilled in the art will readily appreciate, however, that the lockset 100 may include a second handleset 110 mounted to the opposite side of the door 80, and that the second handleset may include features analogous to those described herein with reference to the handleset 110. As described herein, the handleset 110 is operably coupled with the latch mechanism 130 such that the handleset 110 is selectively operable to retract the latchbolt 132.

The handleset 110 generally includes a housing 112 mounted to the door 80, a support spindle 114 rotatably mounted to the housing 112 and extending along a longitudinal axis 102 of the lockset 100, a drive spindle 116 rotatably mounted within the support spindle 114, a return spring 118 urging the support spindle 114 toward a home position, and a handle assembly 120 according to certain embodiments. The support spindle 114 and the drive spindle 116 are rotationally decoupled from one another such that the spindles 114, 116 are rotatable relative to one another.

The handle assembly 120 generally includes a handle 121 mounted to the support spindle 114 and a coupling mechanism 124 operable to selectively couple the handle 121 with the drive spindle 116. The handle 121 includes a shank 122 coupled with the support spindle 114 (e.g., by a set screw 105 or a catch), and a manually graspable member 123 extending from the shank 122. The coupling mechanism 124 generally includes a coupling member 125 and a cam sleeve 126 movably mounted to the shank 122 and operable to engage the coupling member 125. The coupling member 125 has a coupling position in which the coupling member 125 rotationally couples the shank 122 with the drive spindle 116, and a decoupling position in which the shank 122 is rotatable relative to the drive spindle. The cam sleeve 126 has a home position in which the cam sleeve 126 enables the coupling member 125 to move between its coupling position and its decoupling position, and a displaced position in which the cam sleeve 126 retains the coupling member 125 in its coupling position. Further details regarding exemplary forms of the handle assembly 120 are provided below with reference to FIGS. 2-7.

The latch mechanism 130 includes the latchbolt 132, and further includes a retractor 134 operably coupled with the latchbolt 132. The latchbolt 132 has an extended position in which the latchbolt 132 is operable to retain the door 80 in a closed position relative to a doorframe and a retracted position in which the door 80 is free to move from the closed position to an open position. The retractor 134 is operably engaged with the drive spindle 116 such that rotation of the drive spindle 116 causes the latchbolt 132 to move from its extended position to its retracted position. The manner in which the drive spindle 116 is operably coupled with the latch mechanism 130 via the retractor 134 to effect retraction of the latchbolt 132 is known in the art, and need not be described in further detail herein.

Figure 2:
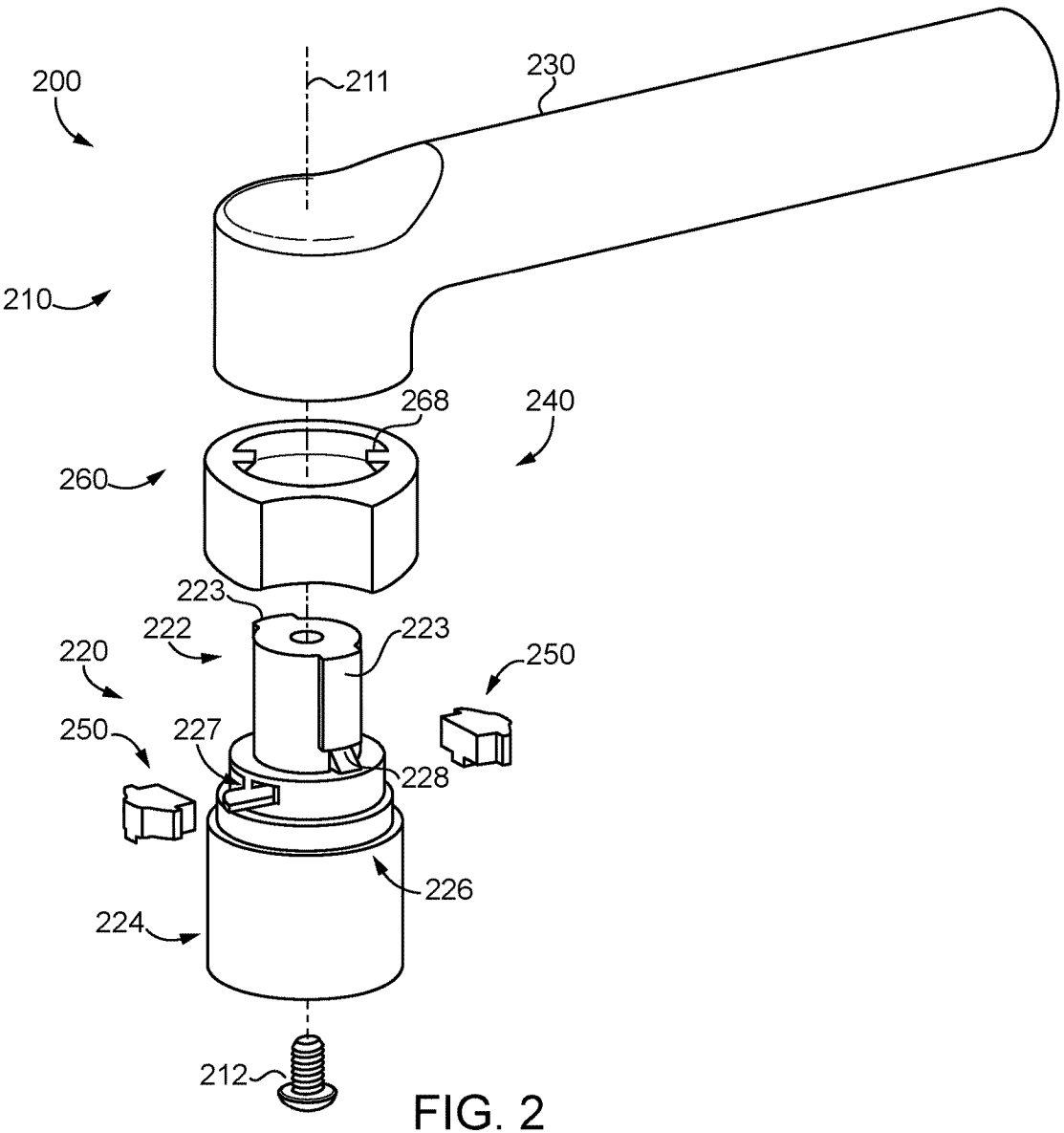
FIG. 2 is an exploded assembly view of a handle assembly according to certain embodiments.
Figure 3:
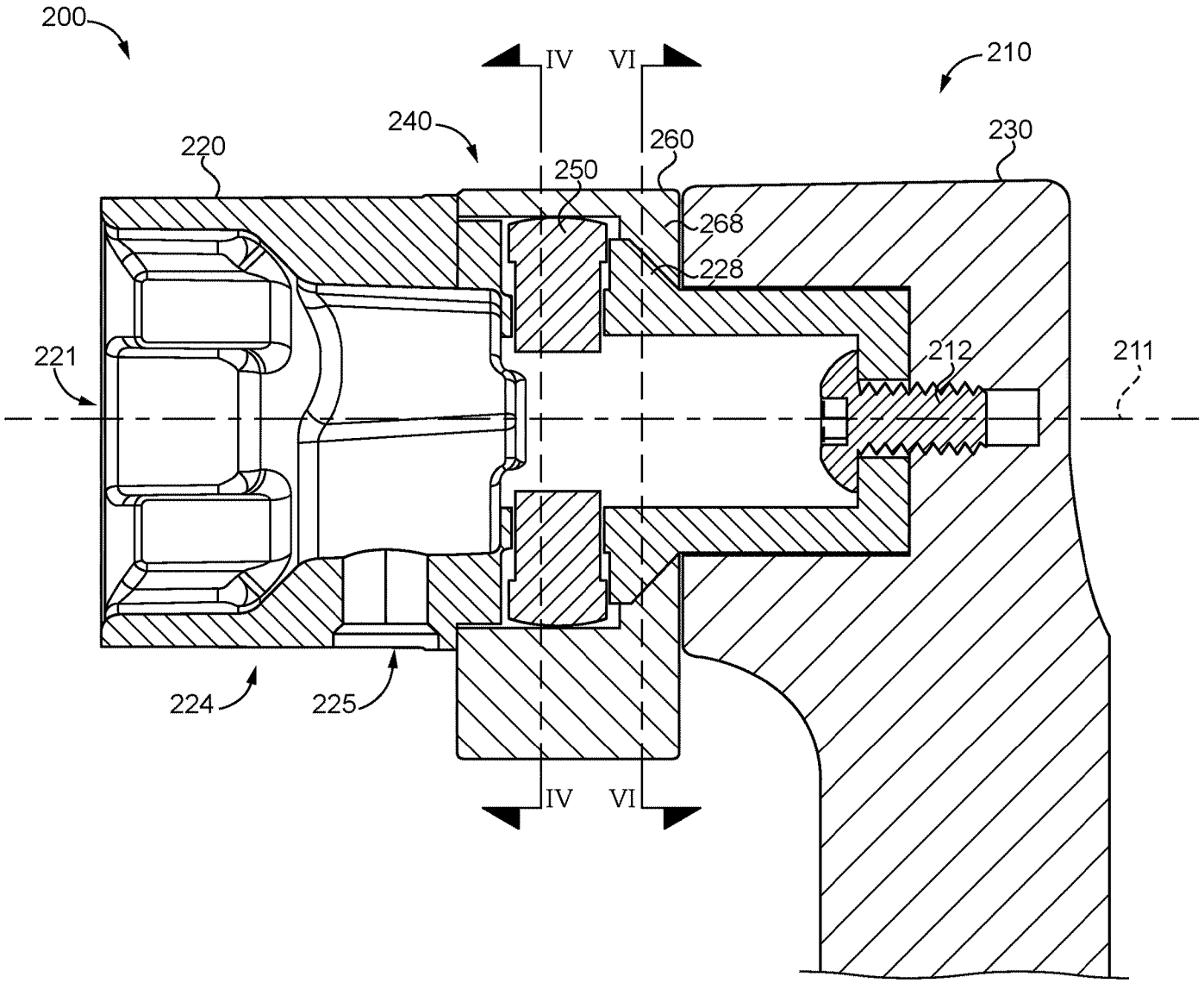
FIG. 3 is a cross-sectional illustration of the handle assembly illustrated in FIG. 2.

With additional reference to FIGS. 2 and 3, illustrated therein is a handle assembly 200 that may, for example, be utilized as the above-described handle assembly 120 for the lockset 100. The handle assembly 200 generally includes a handle 210 configured for mounting to the support spindle 114 and a coupling mechanism 240 operable to selectively rotationally couple the handle 210 with the drive spindle 116. The handle 210 generally includes a shank 220 and a manually graspable member 230 rotationally coupled with the shank 220, and the coupling mechanism 240 generally includes a pair of coupling members 250 and a cam sleeve 260 operably engaged with the coupling members 250.

As described herein, rotation of the cam sleeve 260 from a home position to a rotated position moves the coupling mechanism 240 between a decoupling state and a coupling state. When in the coupling state, the coupling mechanism 240 is operable to rotationally couple the handle 210 with the drive spindle 116 such that rotation of the handle 210 actuates the latch mechanism 130. When in the decoupling state, the coupling mechanism 240 is not operable to rotationally couple the handle 210 with the drive spindle 116 such that rotation of the handle 210 causes the handle 210 to freewheel without actuating the latch mechanism 130. Although the handle 210 freewheels, the handle 210 is nonetheless limited to rotation within a predetermined range by stops formed within the handleset 110. As a result, the degree to which the handle 210 is capable of rotating may remain the same regardless of the coupling/decoupling state of the coupling mechanism 240.

As noted above, the handle 210 generally includes a shank 220 and a manually graspable member 230 extending from the shank 220. The handle 210 may further include a fastener 212 such as a screw by which the manually graspable member 230 is fixed to the shank 220. When mounted to the handleset 110, the handle 210 is operable to rotate or pivot about a longitudinal axis 211 coincident with the longitudinal axis 102.

The shank 220 extends along the longitudinal axis 211, and defines an internal chamber 221 operable to receive the support spindle 114 and the drive spindle 116. The chamber 221 is configured for rotational coupling with the support spindle 114, and is configured to rotatably receive the proximal end portion of the drive spindle 116, which projects beyond the proximal end of the support spindle 114. A proximal portion 222 of the shank 220 defines a pair of splines 223 by which the manually graspable member 230 is rotationally coupled with the shank 220. A distal portion 224 of the shank 220 is configured to rotationally couple with the support spindle 114, and defines a radial aperture 225 connected with the chamber 221. A coupler such as a set screw 105 (FIG. 1) is seated in the aperture 225 and engages the support spindle 114 to longitudinally and rotationally couple the shank 220 and the support spindle 114. An intermediate portion 226 of the shank 220 defines a pair of diametrically-opposed openings 227 in which the pair of coupling members 250 are seated, and is configured to rotatably receive the proximal end of the drive spindle 116.

The manually graspable member 230 extends outward from the shank 220, and is rotationally coupled with the shank 220. For example, an inner surface of the manually graspable member 230 may define a pair of channels that receive the splines 223 to rotationally couple the manually graspable member 230 with the shank 220. The manually graspable member 230 is also longitudinally secured to the shank 220, for example via the fastener 212. While the illustrated manually graspable member 230 is provided in the form of a lever, it is also contemplated that the manually graspable member 230 may be provided in another form, such as that of a knob.

Figure 5:
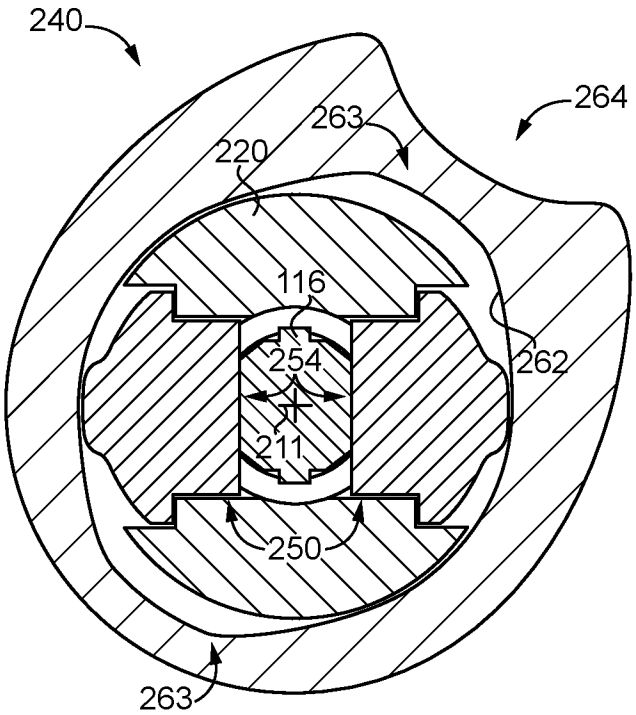
FIG. 5 is a cross-sectional illustration of the handle assembly illustrated in FIG. 2 taken along the line IV-IV in FIG. 3, with the coupling mechanism in a coupling state.
Figure 4:
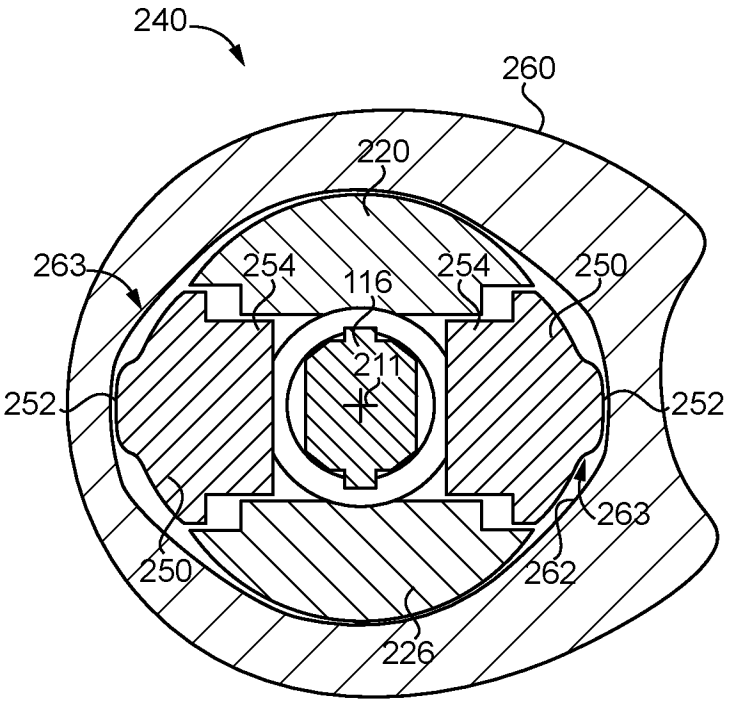
FIG. 4 is a cross-sectional illustration of the handle assembly illustrated in FIG. 2 taken along the line IV-IV in FIG. 3, with a coupling mechanism in a decoupling state.
Figure 6:
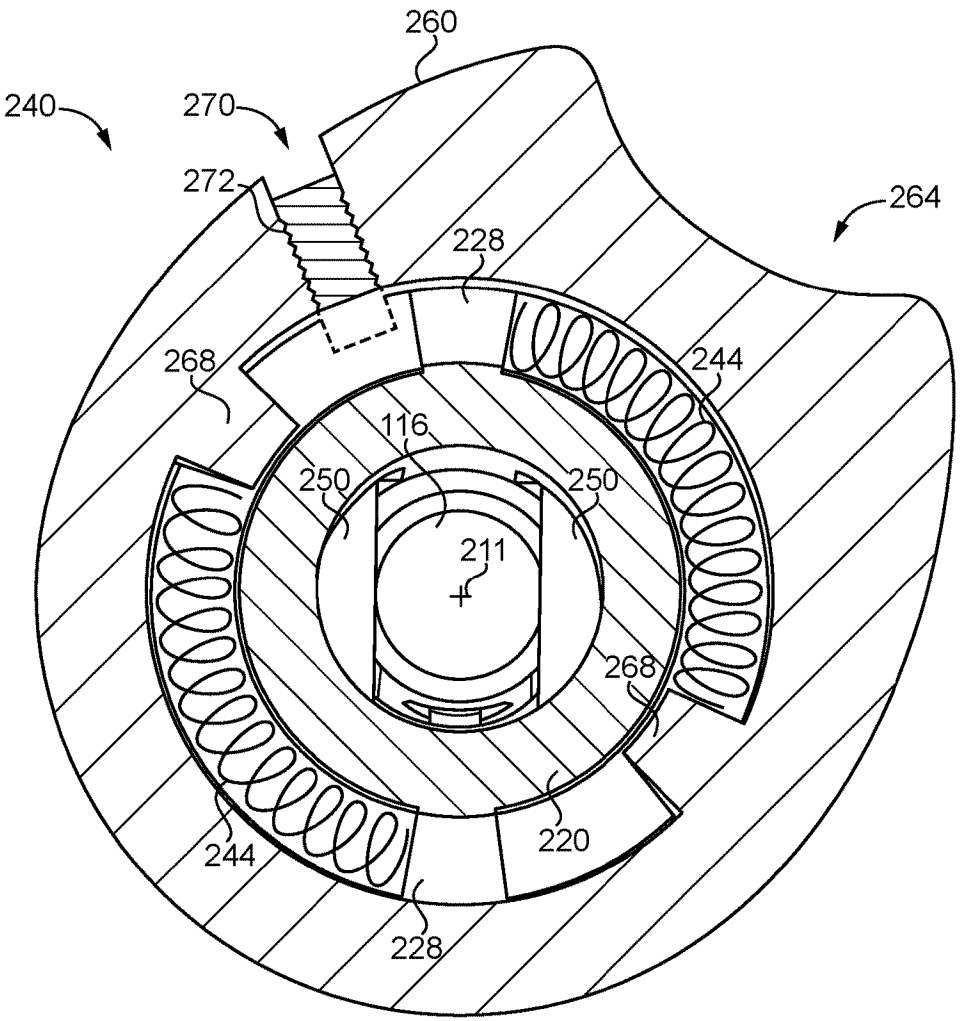
FIG. 6 is a cross-sectional illustration of the handle assembly illustrated in FIG. 2 taken along the line VI-VI in FIG. 3, with the coupling mechanism in the coupling state.

With additional reference to FIGS. 4-6, the coupling mechanism 240 generally includes the coupling members 250 and the cam sleeve 260, and is operable to selectively rotationally couple the handle 210 with the drive spindle 116. In the illustrated form, the coupling mechanism 240 is movably mounted to the intermediate portion 226 of the shank 220. As described herein, the coupling mechanism 240 has a decoupling state and a coupling state. In the decoupling state (FIG. 4), the coupling members 250 are in a radially-outward decoupling position and the cam sleeve 260 is in a home position. In the coupling state (FIGS. 5 and 6), the coupling members 250 are in a radially-inward coupling position and the cam sleeve 260 is in a rotated position. The coupling mechanism 240 may include one or more biasing members urging the coupling mechanism 240 toward the decoupling state. For example, the coupling mechanism 240 may include one or more biasing members such as springs urging the coupling members 250 toward the decoupling position and/or one or more biasing members such as springs 244 urging the cam sleeve 260 toward the home position. In certain forms, the coupling mechanism 240 may further comprise a retainer 270 operable to selectively retain the coupling mechanism 240 in the decoupling state.

The coupling members 250 are slidably mounted in the openings 227 for movement between a radially-outward decoupling position (FIG. 4) and a radially-inward coupling position (FIG. 5). The radially-outer side of each coupling member 250 defines a cam surface 252 configured to interface with the inner cam surface 262 of the cam sleeve 260, and the radially-inner side of each coupling member 250 defines an engagement portion 254 operable to engage the drive spindle 116.

The cam sleeve 260 is rotatably mounted to the intermediate portion 226 of the shank 220 such that the cam sleeve 260 circumferentially surrounds the intermediate portion 226. As a result, the cam sleeve 260 also surrounds the coupling members 250 such that the inner cam surface 262 is operable to engage the coupling members 250. The cam surface 262 is eccentric about the longitudinal axis 211 such that the inner cam surface 262 defines a pair of recesses 263 operable to partially receive the coupling members 250. The outer surface of the cam sleeve 260 defines a grasping portion 264 that facilitates manual grasping of the cam sleeve 260 for rotation between the home position (FIG. 4) and the rotated position (FIG. 5).

The cam sleeve 260 also defines a pair of inward projections 268, and the shank 220 defines a corresponding pair of outward projections 228 operable to overlap the inward projections 268. The springs 244 are seated between the outer surface of the shank 220 and the inner surface of the cam sleeve 260, and are engaged between the projections 228, 268. The springs 244 thereby bias the cam sleeve 260 toward its home position, in which the projections 228, 268 overlap one another. Thus, from the home position, the cam sleeve 260 is operable to rotate in either the clockwise direction toward a first rotated position or the counterclockwise direction toward a second rotated position, and the springs 244 are capable of biasing the cam sleeve 260 toward the home position from each of the rotated positions.

During normal operation of the lockset 100, the coupling mechanism 240 may begin in the decoupling state to which it is biased (FIG. 4). In this state, the cam sleeve 260 is in its home position in which the recesses 263 are aligned with the coupling members 250, thereby permitting the coupling members 250 to move to and/or remain in the radially outward decoupling positions thereof. As a result, the handle 210 is rotationally decoupled from the drive spindle 116. With the coupling mechanism 240 in this state, a user may grip and rotate the handle 210 in an attempt to retract the latchbolt 132. Such rotation of the handle 210 causes a corresponding rotation of the support spindle 114 to which the handle 210 is mounted, but does not cause a corresponding rotation of the drive spindle 116. As a result, the drive spindle 116 does not actuate the latch mechanism 130, and the latchbolt 132 remains in its extended position. When the handle 210 is released, the return spring 118 returns the support spindle 114 to a corresponding home position, thereby returning the handle 210 to its home position. Due to the fact that the return spring 118 biases the support spindle 114 toward its home position, the return spring 118 is capable of returning the handle 210 to its home position regardless of whether the coupling mechanism 240 is in its coupling state or its decoupling state.

In order to actuate the latch mechanism 130, the user may first transition the coupling mechanism 240 from the decoupling state to the coupling state by rotating the cam sleeve 260 from its home position to one of its rotated positions. As the cam sleeve 260 rotates from the home position (FIG. 4) to a rotated position (FIG. 5), the inner cam surface 262 of the cam sleeve 260 engages the outer cam surfaces 252 of the coupling members 250, thereby driving the coupling members 250 to the coupling positions as the recesses 263 become misaligned with the coupling members 250. In other words, the cam sleeve 260 drives the coupling members 250 to the coupling position, thereby transitioning the coupling mechanism 240 to the coupling state.

With the coupling mechanism 240 in the coupling state (FIG. 5), the drive spindle 116 is clamped between the coupling members 250 such that the coupling members 250 are capable of transmitting torque from the shank 220 to the drive spindle 116. Thus, the user may rotate the handle 210 while maintaining the coupling mechanism 240 in the coupling state in order to cause rotation of the drive spindle 116 and retraction of the latchbolt 132. When the cam sleeve 260 is released, the springs 244 return the cam sleeve 260 to its home position, thereby returning the coupling mechanism 240 to its decoupling state.

As should be evident from the foregoing, the coupling mechanism 240 is operable to provide a freewheeling functionality whereby the handle 210 is normally rotatable relative to the drive spindle 116, and is selectively coupled with the drive spindle 116 upon appropriate manipulation of the coupling mechanism 240. In certain forms, the handle assembly 200 may further include a retainer 270 operable to selectively retain the coupling mechanism 240 in the coupling position to thereby disable the freewheeling functionality.

In the illustrated form, the retainer 270 is provided in the form of a set screw 272 mounted to the cam sleeve 260 for movement between a normal position and an advanced position. With the set screw 272 in the normal position, the retainer 270 does not interfere with the operation of the coupling mechanism 240, and the freewheeling functionality is retained. When the cam sleeve 260 is in its rotated position, the set screw 272 can be advanced to its advanced position (illustrated in phantom), in which the set screw 272 engages one of the outward projections 228 to retain the cam sleeve 260 in its rotated position. In this state, the retainer 270 retains the coupling mechanism 240 in its coupling state, and the freewheeling functionality is disabled. As a result, a user can actuate the latch mechanism 130 simply by grasping and turning the handle 210. While the retainer 270 has been illustrated and described as comprising a set screw 272, it should be appreciated that the retainer 270 may be provided in another form, such as that of a pin or a clip that selectively retains the cam sleeve 260 in its rotated position. In certain forms, the retainer 270 may be configured to retain the coupling members 250 in the coupling position without necessarily retaining the cam sleeve 260 in its rotated position.

In the illustrated embodiment, the coupling mechanism 240 comprises a pair of diametrically-opposed coupling members 250, and the drive spindle 116 is clamped between the coupling members 250 when the coupling mechanism 240 is in the coupling state. It is also contemplated that the coupling mechanism 240 may include more or fewer coupling members 250. By way of example, the coupling mechanism 240 may include a single coupling member 250 that projects into an aperture in the drive spindle 116 when the coupling member 250 is in the coupling position, thereby rotationally coupling the shank 220 with the drive spindle 116. Additionally, while the decoupling position and the coupling position for the coupling members 250 are respectively provided as radially-outward and radially-inward positions, it is also contemplated that other positions may be utilized for the decoupling position and the coupling position.

While the illustrated coupling mechanism 240 transitions between its coupling state and its decoupling state in response to rotation of the cam sleeve 260, it is also contemplated that the cam sleeve 260 may move linearly to transition the coupling mechanism 240 between its coupling state and its decoupling state. For example, the user may push or pull the cam sleeve 260 along the direction of the longitudinal axis 211 to transition the coupling mechanism between its coupling state and its decoupling state, for example as described below with reference to FIG. 7. Additionally, although the cam sleeve 260 is illustrated as being biased to its home position by a pair of compression springs 244, it is also contemplated that the cam sleeve 260 may be biased to its home position by another form of biasing member, such as a torsion spring or a magnet.

Figure 7:
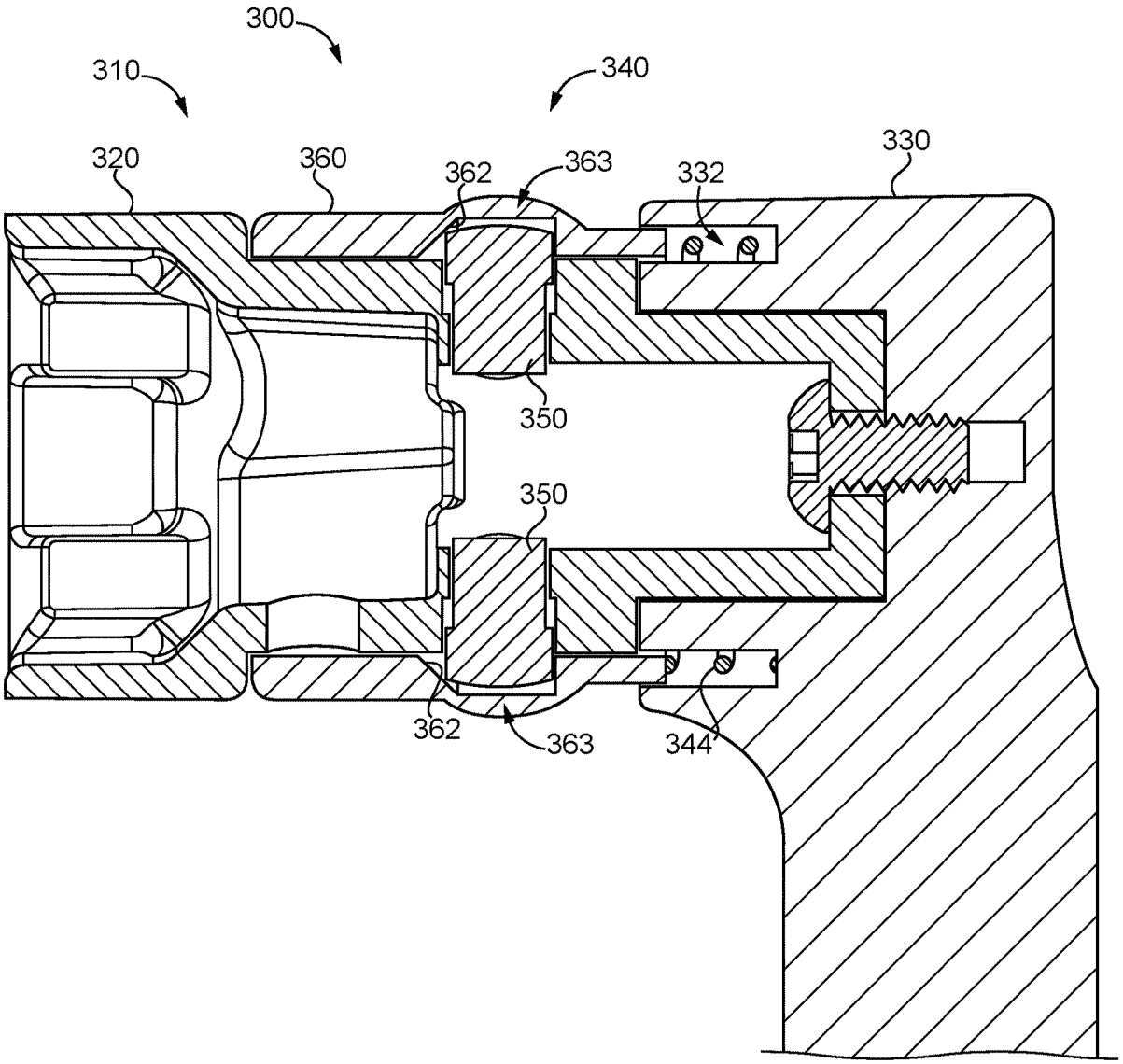
FIG. 7 is a cross-sectional illustration of a handle assembly according to certain embodiments.

With reference to FIG. 7, illustrated therein is a handle assembly 300 that may, for example, be utilized as the handle assembly 120 of the above-described lockset 100. The handle assembly 300 is substantially similar to the above-described handle assembly 200, and similar reference characters are used to indicate similar elements and features. For example, the handle assembly 300 includes a handle 310 having a shank 320 and a manually graspable member 330, and a coupling mechanism 340 including a pair of coupling members 350 and a movable cam sleeve 360. In the interest of conciseness, the following description of the handle assembly 300 focuses primarily on elements and features that are different from those described above with reference to the handle assembly 200. It should be appreciated, however, that elements and features described in connection with only one of the handle assemblies 200, 300 may nonetheless be present in the other of the handle assemblies 200, 300.

In contrast to the above-described handle assembly 200, in which the cam sleeve 260 is mounted for rotation between its home position and its displaced position, the cam sleeve 360 of the current embodiment is mounted for sliding movement between its home position and its displaced position. More particularly, the cam sleeve 360 is movable between a distal home position (to the left in FIG. 7) and a proximal displaced position (to the right in FIG. 7). The manually graspable member 330 includes an annular channel 332 in which a biasing member such as a spring 344 is seated to bias the cam sleeve 360 toward its home position.

The cam sleeve 360 includes a radially-inner cam surface 362 that defines a pair of recesses 363. When the cam sleeve 360 is in its home position, the recesses 363 are aligned with the coupling members 350, thereby permitting the coupling members 350 to move between the radially-inward coupling position and the radially-outward decoupling position. As a result, the coupling mechanism 340 is in its decoupling state, in which the coupling mechanism 340 is not operable to rotationally couple the handle 310 with the drive spindle 116. When the cam sleeve 360 is linearly driven to its displaced position against the biasing force of the spring 344, the recesses 363 become misaligned with the coupling members 350 such that the cam surface 362 urges each coupling members 250 toward its radially-inward coupling position and retains the each coupling member 250 in its coupling position. As a result, the coupling mechanism 340 is in its coupling state, in which the coupling mechanism 340 is operable to rotationally couple the handle 310 with the drive spindle 116.

While the handle assemblies 200, 300 have been described herein as being configured for use with a lockset 100, it is to be appreciated that the handle assemblies 200, 300 may be utilized in connection with devices other than locksets. For example, the handle assemblies 200, 300 may be utilized in connection with a faucet, a stove, or any other item that it is desired to discourage or prevent children from operating. It should also be appreciated that the handle assemblies 200, 300 may be sold in combination with the handleset 110 and/or the lockset 100, or may be provided as a standalone component configured for use with the handleset 110, the lockset 100, or another form of device.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A handle assembly, comprising:

a handle comprising a shank and a manually graspable portion extending from the shank; and a coupling mechanism, comprising:

at least one coupling member mounted to the shank for movement between a first position and a second position, wherein the at least one coupling member projects beyond a radially-inner surface of the shank when in the first position; and a cam sleeve movably mounted to the shank and covering the at least one coupling member, a radially-inner portion of the cam sleeve including at least one cam surface operable to engage the at least one coupling member, wherein the at least one cam surface is configured to drive the at least one coupling member from the second position to the first position as the cam sleeve is displaced from a home position to a displaced position; and a spring engaged between the handle and the cam sleeve, wherein the spring urges the cam sleeve toward the home position when the cam sleeve is in the displaced position.

2. The handle assembly of claim 1, wherein the cam sleeve is rotatably mounted to the shank and is configured to rotate between the home position and the displaced position.

3. The handle assembly of claim 2, wherein the cam sleeve is operable to rotate from the home position to the displaced position in a first rotational direction;

wherein the cam sleeve is operable to rotate from the home position to a rotated position in a second rotational direction opposite the first rotational direction; and wherein the at least one cam surface is configured to drive the at least one coupling member from the second position to the first position as the cam sleeve rotates from the home position to the rotated position.

4. The handle assembly of claim 3, wherein the spring urges the cam sleeve toward the home position when the cam sleeve is in the rotated position.

5. The handle assembly of claim 1, wherein the cam sleeve is slidably mounted to the shank and is configured to slide along a rotational axis of the shank between the home position and the displaced position.

6. The handle assembly of claim 1, wherein, with the at least one coupling member in the first position, the coupling mechanism is operable to couple the handle to a drive spindle; and wherein, with the at least one coupling member in the second position, the coupling mechanism is inoperable to couple the handle to the drive spindle.

7. The handle assembly of claim 1, wherein the cam sleeve is biased toward the home position.

8. The handle assembly of claim 1, wherein the manually graspable portion comprises a lever.

9. The handle assembly of claim 1, further comprising a retainer operable to selectively retain the cam sleeve in the home position.

10. The handle assembly of claim 9, wherein the coupling member is configured to selectively retain the at least one coupling member in the first position by selectively retaining the cam sleeve in the displaced position.

11. The handle assembly of claim 1, wherein the at least one coupling member comprises a pair of the coupling members, and wherein the pair of coupling members are positioned diametrically opposite one another.

12. The handle assembly of claim 1, wherein the first position is a radially-inward position and the second position is a radially-outward position.

13. A handleset comprising the handle assembly of claim 1, further comprising:

a housing;

a support spindle rotatably mounted to the housing, wherein the handle is mounted to the support spindle; and a drive spindle rotatably mounted to the housing and rotatable relative to the support spindle;

wherein, with the at least one coupling member in the first position, the at least one coupling member is engaged with the drive spindle such that the drive spindle is rotationally coupled with the handle; and wherein, with the at least one coupling member in the second position, the drive spindle is rotationally decoupled from the handle.

14. The handleset of claim 13, further comprising a spring urging the drive spindle toward a drive spindle home position;

wherein the manually graspable portion comprises a lever having a horizontal position when the drive spindle is in the home position; and wherein the spring biases the lever to the horizontal position when the at least one coupling member is in the first position and when the at least one coupling member is in the second position.

15. A lockset comprising the handleset of claim 13, wherein the lockset further comprises a bolt having an extended position and a retracted position; and wherein the bolt is operably connected with the drive spindle such that rotation of the drive spindle drives the bolt between the extended position and the retracted position.

16. A handleset, comprising:

a housing configured for mounting to a door;

a support spindle rotatably mounted to the housing and biased toward a support spindle home position;

a drive spindle rotatably mounted to the housing, wherein the support spindle and the drive spindle are rotatable relative to one another;

a handle mounted to the support spindle; and a coupling mechanism operable to selectively couple the handle with the drive spindle, the coupling mechanism comprising:

a coupling member movably mounted to the handle, the coupling member having a coupling position in which the coupling member rotationally couples the handle with the drive spindle, the coupling member having a decoupling position in which the handle is rotatable relative to the drive spindle; and a cam sleeve movably mounted to the handle for movement between a first position and a second position, wherein the cam sleeve is configured to retain the coupling member in the coupling position when in the first position, and to permit the coupling member to move toward the decoupling position when in the second position; and a bias mechanism biasing the cam sleeve toward the first position.

17. The handleset of claim 16, wherein the cam sleeve is rotatably mounted to the handle and is configured to rotate between the first position and the second position.

18. The handleset of claim 16, wherein the cam sleeve is slidably mounted to the handle and is configured to move along a rotational axis of the handle between the first position and the second position.

19. The handleset of claim 16, wherein the cam sleeve is biased toward the second position.

20. The handleset of claim 19, further comprising a retainer operable to selectively retain the cam sleeve in the first position.

21. A lockset including the handleset of claim 16, and further comprising a latch mechanism including a latchbolt having an extended position and a retracted position; and wherein the latch mechanism is engaged with the drive spindle such that rotation of the drive spindle drives the latchbolt between the extended position and the retracted position.

22. A handle assembly, comprising:

a shank extending along a longitudinal axis, wherein the shank comprises a central opening and a pair of radial apertures communicating with the central opening;

a manually graspable portion coupled with the shank;

a pair of coupling members slidably seated in the pair of radial apertures for movement between a radially-inward first position and a radially-outward second position;

a cam sleeve movably mounted to the shank and comprising a pair of recesses operable to partially receive the pair of coupling members, wherein the cam sleeve has a home position in which the recesses are aligned with the coupling members to permit the coupling members to move from the radially-inward first position to the radially-outward second position, and wherein the cam sleeve has a displaced position in which the recesses are misaligned with the pair of coupling members and the cam sleeve retains the coupling members in the radially-inward first position; and a spring urging the cam sleeve toward the home position.

23. The handle assembly of claim 22, wherein the cam sleeve is biased toward the home position.

24. The handle assembly of claim 23, further comprising a retainer operable to selectively retain the cam sleeve in the displaced position.

25. The handle assembly of claim 22, wherein the cam sleeve includes a radially-inner cam surface defining the pair of recesses, and wherein the cam surface is configured to drive the coupling members from the second position to the first position as the cam sleeve moves between the home position and the displaced position.

26. A handleset comprising the handle assembly of claim 22, further comprising:

a housing;

a support spindle rotatably mounted to the housing, wherein the handle is mounted to the support spindle; and a drive spindle extending through the support spindle and rotatable relative to the support spindle;

wherein, with the coupling members in the first position, the support spindle is clamped between the coupling members such that the coupling members rotationally couple the drive spindle and the shank; and wherein, with the coupling members in the second position, the shank is rotatable relative to the drive spindle.

* * * * *